US005979184A

United States Patent [19]

Razza

[11] Patent Number: 5,979,184

[45] Date of Patent: Nov. 9, 1999

[54] CONVERTIBLE JEWELRY ARTICLE

[75] Inventor: Luca Razza, West Warwick, R.I.

[73] Assignee: Plaza Jewelry, Inc., Cranston, R.I.

[21] Appl. No.: 09/165,600

[22] Filed: Oct. 2, 1998

[51] Int. Cl.[6] ..... A44C 13/00

[52] U.S. Cl. ..... 63/1.11; 63/3; 63/3.1; 63/23; 446/250

[58] Field of Search ..... 63/1.11, 1.12, 63/1.13, 1.16, 1.17, 3, 3.1, 3.2, 21, 23, 31, 41; 446/247, 248, 249, 250, 251, 252, 253, 254; D11/2; D21/463, 464

[56] References Cited

U.S. PATENT DOCUMENTS

| | | | |
|---|---|---|---|
| 422,381 | 3/1890 | Cole | 63/21 X |
| 1,138,405 | 5/1915 | Pearce | 63/21 X |
| 2,084,151 | 6/1937 | Leitner | 63/3.1 |
| 2,337,334 | 12/1943 | Lohr | 446/250 |
| 2,645,881 | 7/1953 | Frangos | 446/250 |
| 2,779,523 | 1/1957 | Klimkiewicz | 63/3 X |
| 3,089,277 | 5/1963 | Reese, Jr. | 446/251 |
| 3,170,311 | 2/1965 | Raphael | 63/3.1 |
| 3,481,155 | 12/1969 | Cook | 63/3 X |
| 4,270,366 | 6/1981 | Green | 63/3 |
| 4,273,275 | 6/1981 | Vadnais | 224/101 |

*Primary Examiner*—Terry Lee Melius
*Assistant Examiner*—Andrea Chop
*Attorney, Agent, or Firm*—Salter & Michaelson

[57] ABSTRACT

A combination jewelry article and toy for use as both a necklace and a yo-yo. The combination jewelry article and toy includes a pendant having a front portion and a rear portion connected by a post, and at least one aperture disposed in the pendant. A first end of a cord or chain is attached to the post of the pendant, while a second end of the cord is attached to an engagement member, such as a clasp. In a first position, the clasp is secured through the aperture in the pendant, so that both ends of the cord are attached to the pendant. In this manner, the cord is formed into a large loop which may be positioned around the neck of the user so that the pendant and cord may be worn as a necklace. In a second position, the clasp is secured to the cord in the area of the second end so that a finger loop is formed. The user can then wrap the cord around the post of the pendant, insert his or her finger into the finger loop at the second end of the cord and use the pendant and cord as a yo-yo.

13 Claims, 4 Drawing Sheets

CONVERTIBLE JEWELRY ARTICLE

DESCRIPTION

1. Technical Field

The present application relates to a convertible jewelry article, and more particularly to a necklace which can be converted for use as a yo-yo.

2. Background of Related Art

Articles of jewelry having multiple uses are well known in the art. For example, pendants and rings which open to hold a trinket, pins which may also be utilized as pendants, and pendants which open to reveal a time mechanism are all examples of articles of jewelry which serve more than one purpose. In particular, such articles of jewelry may be both fashionable and functional, providing a consumer with an accessory having both cosmetic and utilitarian appeal. In designing articles of jewelry, therefore, it is sometimes desirable to incorporate more than one use into the article of jewelry.

SUMMARY

In accordance with the present invention, there is provided a convertible jewelry article which may be worn around the neck of a user as a necklace, or which may be converted for use as a yo-yo. The convertible jewelry article includes a pendant having a front portion and a rear portion connected by a post, and at least one aperture preferably at the periphery of the pendant. A first end of a cord or chain is attached to the post of the pendant, while a second end of the cord is attached to an engagement member, such as a clasp. In a first position, the clasp is secured through the aperture in the pendant, so that both ends of the cord are attached to the pendant. In this manner, the cord is formed into a large loop which may be positioned around the neck of the user so that the pendant and cord may be worn as a necklace. In a second position, the clasp is secured to the cord in the area of the second end so that a finger loop is formed. The user can then wrap the cord around the post of the pendant, insert his or her finger into the finger loop at the second end of the cord and use the pendant and cord as a yo-yo.

The front and rear portions of the pendant are preferably symmetrical and may be round in shape. The pendant may also include a plurality of apertures disposed around the periphery thereof, the apertures being incorporated into the aesthetic design of the pendant.

It is therefore an object of the present invention to provide an article of jewelry which can readily be converted between a necklace and a yo-yo by the user.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATED EMBODIMENTS

Figure 1:
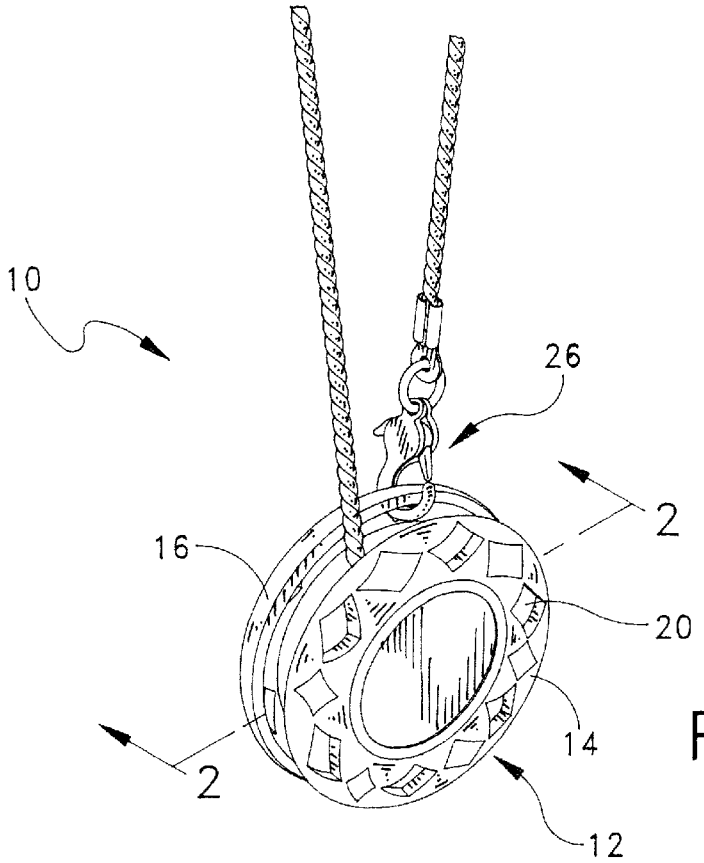
FIG. 1 is a perspective view of one embodiment of a convertible jewelry article according to the present invention in a first position with a cord and a clasp attached to a pendant for use as a necklace.
Figure 6:
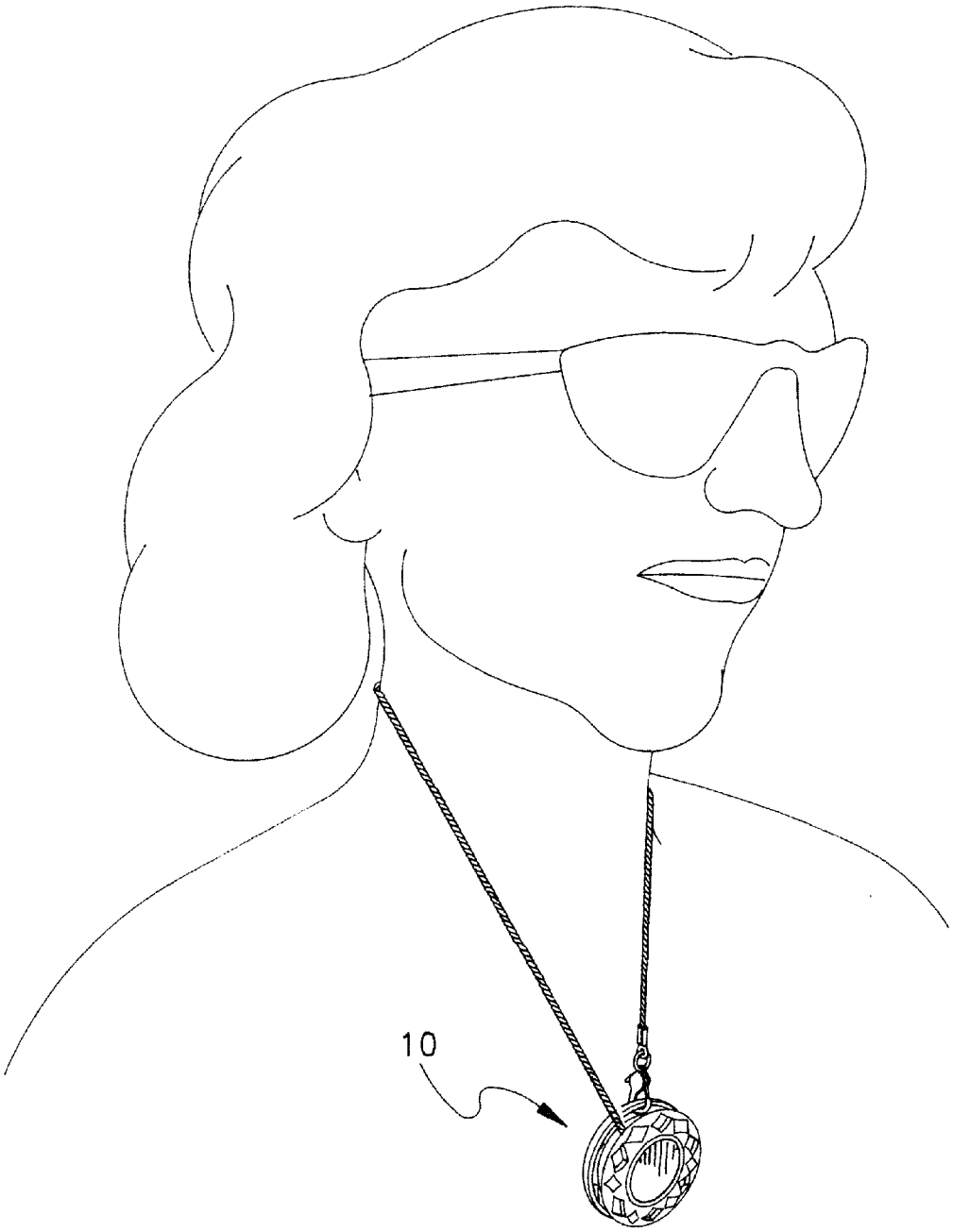
FIG. 6 is a perspective view of the convertible jewelry article of FIG. 1 in a first position with the clasp forming a large loop for use as a necklace.

A convertible jewelry article 10 for use as both a necklace and a yo-yo is illustrated in FIG. 1. The convertible jewelry article 10 includes a pendant 12 having a front portion 14 and a rear portion 16 connected by a post 18 (FIG. 2), and at least one aperture 20 preferably disposed at the periphery of the pendant. The first end 22 of a chain or cord 24 is attached to post 18, while a second end of the cord 24 is attached to an engagement member or clasp 26. In the embodiment of FIG. 1, the clasp 26 is secured through aperture 20 in the rear portion of the pendant, so that both the first end 22 and the second end 28 of the cord 24 are attached to the pendant. In this manner, the cord is formed into a large loop which may be positioned around the neck of the user so that the pendant and cord can be worn as a necklace (see FIG. 6).

The pendant 12 may include six, diamond shaped apertures along the periphery of both the front portion 14 and the rear portion 16, the apertures in the front and rear portion being aligned in the present embodiment. Alternatively, the apertures may be any shape and size, provided however, that the apertures are dimensioned to receive clasp 26. The apertures may be disposed through just the front or rear portion, or may be disposed through both the front and rear portions and may be offset from one another instead of being aligned. The number, shape, size and position of the apertures, therefore, may be varied according to the designers preference, as would be apparent to one of skill in the art. The front portion 14 and rear portion 16 may also include a decorative design on the face thereof, and may preferably be round, as illustrated in FIG. 1. In the present embodiment, the front and rear portions each have a diameter of approximately 1.25 inches and are made from a gold-plated metal. Alternately, the front and rear portions may have a plain facade, be a shape other than round, be any desired size and may be made from alternate materials such as plastic. The post 18 connecting the front and rear portions is preferably cylindrical so that the first end 22 of cord 24 may be readily wound around the post when used as a yo-yo, as described below.

Figure 2:
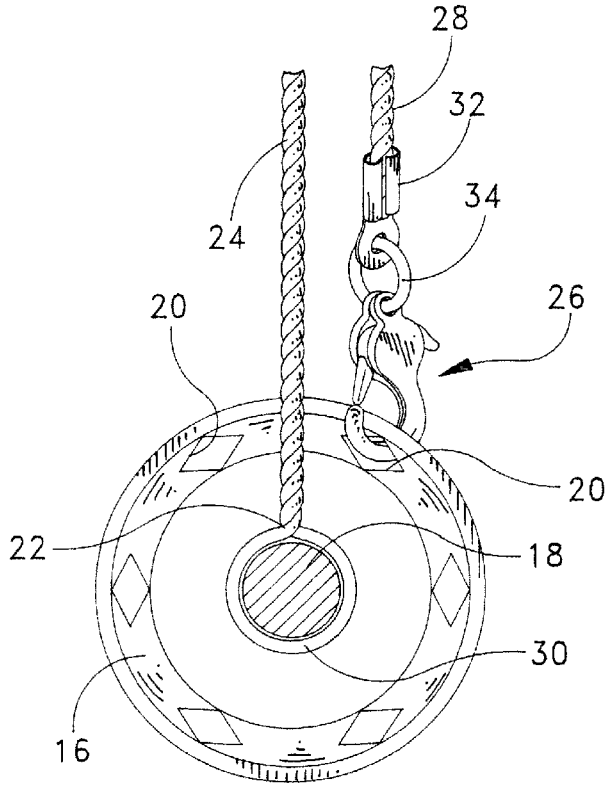
FIG. 2 is a front view of the convertible jewelry article of FIG. 1 taken along lines 2—2.

As illustrated in FIG. 2, the cord 24 may be formed from a continuous strand of string 30 which may be wound around post 18 and then twisted together to form cord 24. Alternatively, the cord may formed of any number of strands and may be attached to the post in any manner. In addition, the cord may be in the form of a chain, provided that the chain is of sufficient flexibility for use with the pendant as a yo-yo. In the present embodiment, cord 24 is about 26 inches in length, although alternate lengths may be utilized according to the designer's preference. The cord's length should, however, be sufficient to be wound around the post 18 in order to be utilized with the pendant as a yo-yo, as described in greater detail below. The second end 28 of cord 24 may preferably include a connection member 32 for connecting the clasp 26 to the second end of the cord. In the illustrative embodiment, a ring 34 connects the clasp 26 to the connection member 32. Clasp 26 may be utilized to selectively and removably attach the second end of the cord to the pendant.

Figure 3:
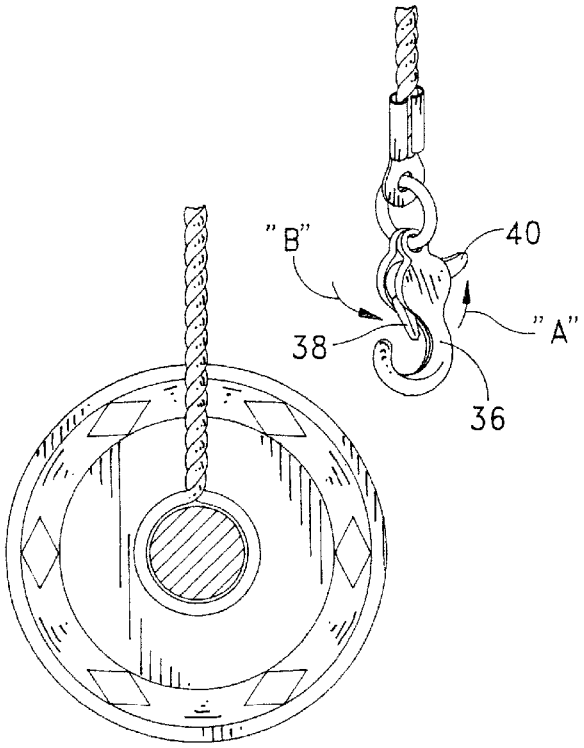
FIG. 3 is a front view of the convertible jewelry article of FIG. 2 with the clasp removed from the pendant.

Clasp 26 may include a body 36 and a leg 38, the body and leg forming a "lobster-claw"-style clasp in the present embodiment (FIG. 3). Leg 38 may be pivoted between a closed and open position by actuation of lever 40. As shown in FIG. 3, actuation of lever 40 by a user in the direction of arrow "A", pivots leg 38 in the direction of arrow "B", into the open, or released, position. Leg 38 may be normally biased into the closed, or engaged, position (FIG. 2), for example by a spring (not shown) disposed in the body portion of the clasp, as is conventional. Alternatively, the clasp may be a spring-ring clasp, or any other member which would allow the user to selectively attach and disengage the second end of the cord 24 from pendant 12, including the cord alone, as would be known to one of skill in the art.

Figure 4:
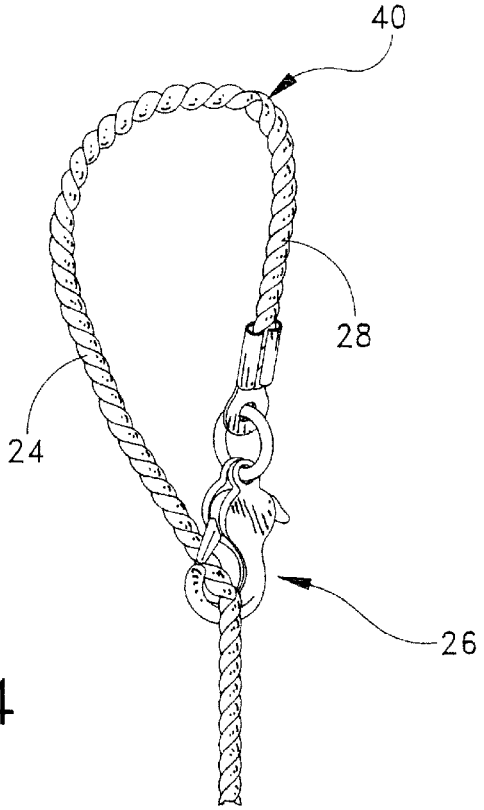
FIG. 4 is a perspective view of the convertible jewelry article of FIG. 1 with a finger loop formed by the clasp being attached at one end to the cord.
Figure 5:
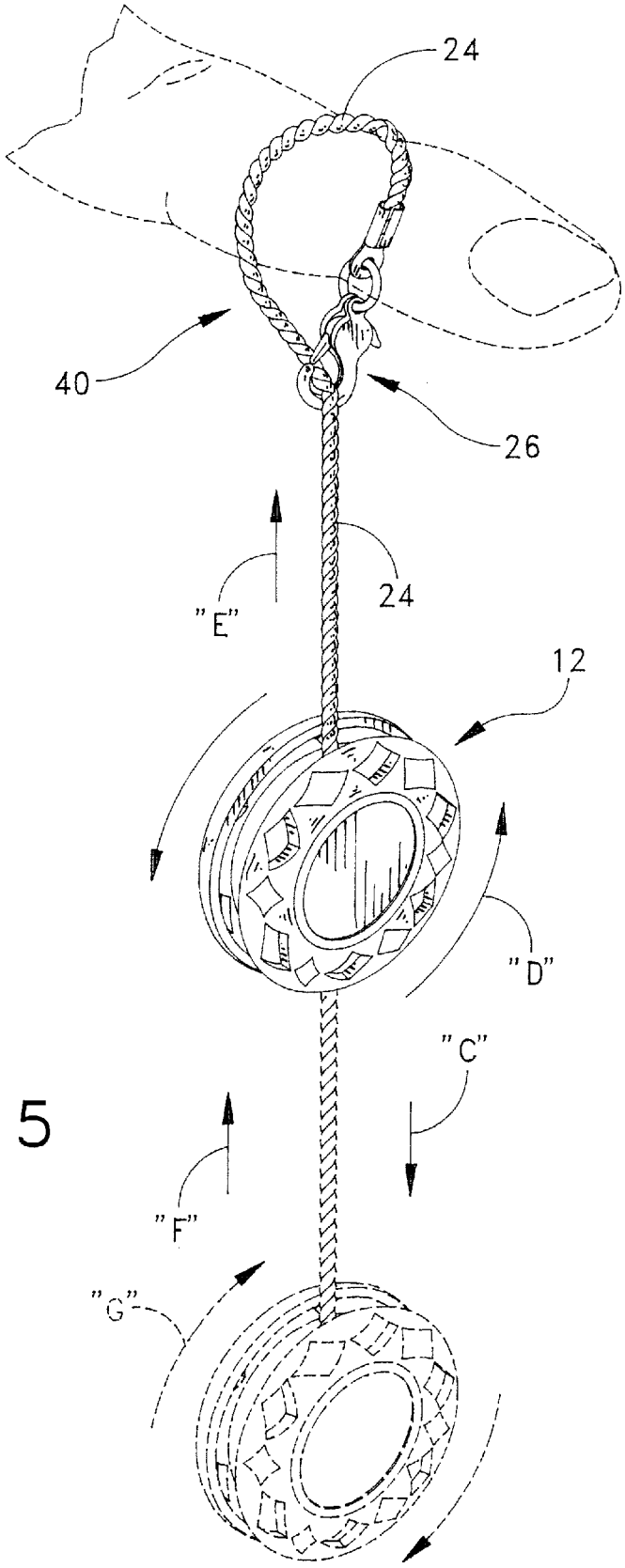
FIG. 5 is a perspective view of the convertible jewelry article of FIG. 1 in a second position with the clasp forming a finger loop, for use as a yo-yo.

In order to utilize the pendant and cord as a yo-yo, the second end of the cord must first be disengaged from the pendant, as shown in FIG. 3. Once disengaged from the pendant, the user can secure the clasp 26 to the cord 24 in the area adjacent the second end 28 of the cord, so that a loop 40 is formed, as shown in FIG. 4. The length of the cord is then wrapped around the post 18 of the pendant, up to about the loop 40. The user can then insert his or her finger into the loop, and the loop may be tightened around the user's finger. Once the user has inserted his or her finger into the finger loop, as shown in FIG. 5, the user releases the pendant so that the length of cord unwraps from the post as the pendant rotates and moves in a downward direction, away from the user as indicated by arrows "C" and "D". Once the cord has unwrapped from the post, the user utilizes the finger loop to pull on the cord in an upward direction, toward the user as indicated by arrow "E", thus forcing the cord to wrap around the post so as to rotate and move the pendant in the upward direction as indicated by arrows "F" and "G". The downward motion is thereafter repeated, such that the pendant and cord function as a conventional yo-yo.

In use, the convertible jewelry article of the present invention may be readily converted from a necklace to a yo-you and vice versa by a user, simply by connecting the clasp to either the pendant (for a necklace) or the end of the cord (for a yo-yo). This provides a user with an ornamental piece of jewelry which can also be utilized as a toy.

It will be understood that various modifications may be made to the embodiment disclosed herein. For example, the size, dimensions and geometric configuration of the pendant may be varied, the size of the cord may be varied, and various style clasps may be utilized. In addition, the clasp may be fastened through an aperture in either the front portion or rear portion of the pendant. Therefore, the above description should not be construed as limiting, but merely as exemplifications of a preferred embodiment. Those skilled in the art will envision other modifications within the scope spirit of the invention.

I claim:

1. An article of jewelry constructed and arranged to be converted between a necklace and a yo-yo and vice versa, comprising:

a pendant including a front portion, a rear portion and a post connecting the front portion to the rear portion;

at least one aperture disposed through one of the front or rear portion;

a cord including a first end attached to the post and a second end opposite the first end;

an engagement member supported by the second end of the cord and attachable to the pendant through the at least one aperture; and wherein in a first position the second end of the cord is attached to the pendant by the engagement member being received through the at least one aperture, so that a loop is formed which is sized to be worn around the neck of a user, and wherein in a second position the engagement member is attached to the cord in an area adjacent the second end of the cord, so that a finger loop is formed for use as a yo-yo.

2. The article of claim 1, wherein the at least one aperture comprises at least two apertures, one aperture disposed through the front portion and another aperture disposed through the rear portion of the pendant.

3. The article of claim 2, wherein the aperture disposed through the front portion is aligned with the aperture disposed through the rear portion.

4. The article of claim 2, wherein the aperture disposed through the front portion is offset from the aperture disposed through the rear portion.

5. The article of claim 1, wherein the at least one aperture is disposed adjacent a periphery of the pendant.

6. The article of claim 1, wherein the front portion and the rear portion are symmetrical.

7. The article of claim 1, wherein the front portion and the rear portion are round.

8. The article of claim 1, wherein the engagement member is a clasp.

9. The article of claim 8, wherein the clasp is a lobster-claw clasp.

10. A method of converting an article of jewelry between a necklace and a yo-yo, the article of jewelry including a pendant having a front portion, a rear portion, at least one aperture disposed through one of the front portion and rear portion, a post connecting the front portion to the rear portion, and a cord having a first end attached to the post and a second end supporting an engagement member, the method comprising the steps of:

attaching the engagement member to the at least one aperture in the pendant so as to form a loop sized to fit around a neck of a user for use as a necklace;

disengaging the engagement member from the pendant;

attaching the engagement member to the cord, adjacent the second end thereof so as to form a loop sized to fit around a finger of the user; and wrapping a length of the cord around the post of the pendant, up to about the loop sized to fit around the finger of the user, for use as a yo-yo.

11. The method of claim 10, further comprising the step of inserting the user's finger into the finger loop.

12. The method of claim 10, further comprising the step of releasing the pendant so that the length of cord unwraps from the post as the pendant rotates and moves in a downward direction, away from the user.

13. The method of claim 12, further comprising the step of pulling on the cord in the direction of the user, so that the cord wraps around the post, thus moving the pendant in the upward direction toward the user.

* * * * *